US005563698A

United States Patent [19]

Okada

[11] Patent Number: 5,563,698

[45] Date of Patent: Oct. 8, 1996

[54] SHEET SUPPLY APPARATUS HAVING MANUAL INSERTION GUIDE

[75] Inventor: Tamotsu Okada, Kawasaki, Japan

[73] Assignee: Canon Kabushiki Kaisha, Tokyo, Japan

[21] Appl. No.: 235,800

[22] Filed: Apr. 29, 1994

[30] Foreign Application Priority Data

May 10, 1993 [JP] Japan ..... 5-131011
Mar. 10, 1994 [JP] Japan ..... 6-039666

[51] Int. Cl.[6] ..... G03G 21/00

[52] U.S. Cl. ..... 355/309; 271/9.09

[58] Field of Search ..... 355/308, 309, 355/318, 319, 200; 271/9, 9.09, 913, 240, 248, 171

[56] References Cited

U.S. PATENT DOCUMENTS

| | | | |
|---|---|---|---|
| 4,484,737 | 11/1984 | Sugiyama | 355/309 X |
| 4,751,552 | 6/1988 | Itoigawa | 355/200 |
| 4,760,424 | 7/1988 | Ohba et al. | 355/245 |
| 4,878,428 | 11/1989 | Watarai | 355/309 X |
| 5,130,759 | 7/1992 | Fushimi et al. | 355/319 |
| 5,144,386 | 9/1992 | Matsuo et al. | 355/321 |
| 5,196,897 | 3/1993 | Trask | 355/319 |
| 5,287,158 | 2/1994 | Nagashima et al. | 355/309 |
| 5,291,256 | 3/1994 | Kitajima et al. | 355/290 |

FOREIGN PATENT DOCUMENTS

| | | |
|---|---|---|
| 239317 | 9/1987 | European Pat. Off. . |
| 281073 | 9/1988 | European Pat. Off. . |
| 361426 | 4/1990 | European Pat. Off. . |

*Primary Examiner*—Robert Beatty
*Attorney, Agent, or Firm*—Fitzpatrick, Cella, Harper & Scinto

[57] ABSTRACT

In order to supply a sheet to an image forming device, there is provided a manual insertion guide for supporting a manually inserted sheet and a cassette for supporting a sheet to be automatically supplied, and a guide portion for guiding the sheet fed from the cassette is integrally formed with the manual insertion guide. The manual insertion guide has side regulating members for regulating the side edges of the manually inserted sheet.

22 Claims, 11 Drawing Sheets

SHEET SUPPLY APPARATUS HAVING MANUAL INSERTION GUIDE

BACKGROUND OF THE INVENTION

1. Field of the Invention

The present invention relates to an image forming apparatus for recording an image in response to image information on a recording material supplied from a plurality of sheet supply means.

2. Related Background Art

In the past, in image forming apparatuses such as copying machines, as sheet supply means, there have been used a manual insertion sheet supply means in which recording materials (referred to as "sheets" hereinafter) are manually inserted one by one into a manual insertion opening to be supplied to an image forming portion and an automatic sheet supply means in which sheets stacked in a cassette or on a tray are separated one by one and the separated sheet is supplied to an image forming portion. Further, image forming apparatuses having the combination of these sheet supply means have also been usually used.

Now, an example of a conventional copying machine having the above-mentioned manual insertion sheet supply means and automatic sheet supply means will be explained with reference to FIGS. 9 to 11. The copying machine inherently includes the manual insertion sheet supply means and the automatic sheet supply means is added to the machine as an option.

The copying machine includes manual insertion guide members 91 through which a sheet P is supplied by manual insertion, which guide members can be shifted relatively in directions shown by the double headed arrow C to regulate the sheet P in its widthwise direction by their inner guide surfaces 91*a*, as shown in FIG. 10. A first convey path 92 for guiding the manually inserted sheet P in a direction shown by the arrow A is defined between the manual insertion guides 91. Further, in FIG. 9, there is also provided a second sheet convey path 95 for guiding a sheet P supplied by a sheet convey roller 94 from a cassette 93 mounted within a lower portion of the apparatus in a direction shown by the arrow B.

At a junction between the first and second convey paths 92, 95, a junction guide 96 is integrally formed with a body of the apparatus. The junction guide 96 forms a part of an outer wall of the body of the apparatus. The sheet P conveyed through the first or second convey path 92 or 95 is sent toward the interior of the apparatus by means of a pair of convey rollers 97.

In this way, generally, in the image forming apparatus having both the manual insertion sheet supply means and the automatic sheet supply means, the first convey path 92 for exclusively guiding the sheet supplied by the manual insertion sheet supply means and the second convey path 95 defined by the junction guide 96 and adapted to exclusively guide the sheet supplied by the automatic sheet supply means are dependently formed, so that the sheet P is directed to the pair of convey rollers 97 to be sent to an image forming portion.

However, in the above-mentioned conventional image forming apparatus, it is necessary to previously form the second convey path 95 in the apparatus by using the junction guide 96 and the like. When an electric portion 98 (shown by the two dot and chain line in FIG. 9) is mounted within a lower portion of the apparatus in consideration of compactness of the apparatus, the second convey path 95 does not provide an installation space for the electric portion and the junction guide 96 creates a dead space, thereby reducing the effective installation space for the electric portion in the apparatus.

Further, regarding the above-mentioned image forming apparatus, as shown in FIG. 11, even if the apparatus has the manual insertion sheet supply means alone, as mentioned above, it is necessary to provide the second convey path 95 and an opening 95*a* therefor. Further, if the automatic sheet supply portion is driven by a drive source of the image forming apparatus, it is also necessary to provide an opening 99 for permitting the drive connection between the automatic sheet supply portion and the image forming apparatus. In this case, there is no problem when the automatic sheet supply portion is integrally mounted to the image forming portion. However, when the image forming apparatus having the manual insertion sheet supply means alone is used independently, there is a danger of foreign matters entering into the apparatus through the openings 95*a*, 99, thereby causing the malfunction of the apparatus. Further, some modern compact image forming apparatuses must be made to withstand the storage and transportation thereof. In such a case, any members 100 for closing the openings 95*a*, 99 must be prepared, thereby making the apparatus more expensive.

SUMMARY OF THE INVENTION

An object of the present invention is to provide an image forming apparatus which can eliminate the above-mentioned conventional drawbacks and can be made more compact and cheaper and which can accommodate easy option.

In order to achieve the above object, according to the present invention, there is provided an image forming apparatus comprising a first sheet supply means for supplying a recording material by manual insertion, a second sheet supply means for automatically supplying a recording material, first and second convey paths for guiding the recording materials supplied from the first and second sheet supply means, an image forming means for recording an image on the recording material in response to image information, and a guide member having first and second guide surfaces for guiding the recording materials conveyed in the first and second convey paths.

With this arrangement, the manually inserted recording material is supplied by the first sheet supply means and is sent to the image forming means through the first convey path. On the other hand, the recording material automatically supplied by the second sheet supply means is sent to the image forming means through the second convey path. Since the first and second guide surfaces for guiding the recording material are integrally formed at a junction between the first and second convey paths, the second convey path is not required to be formed independently.

DETAILED DESCRIPTION OF THE PREFERRED EMBODIMENTS

Figure 1:
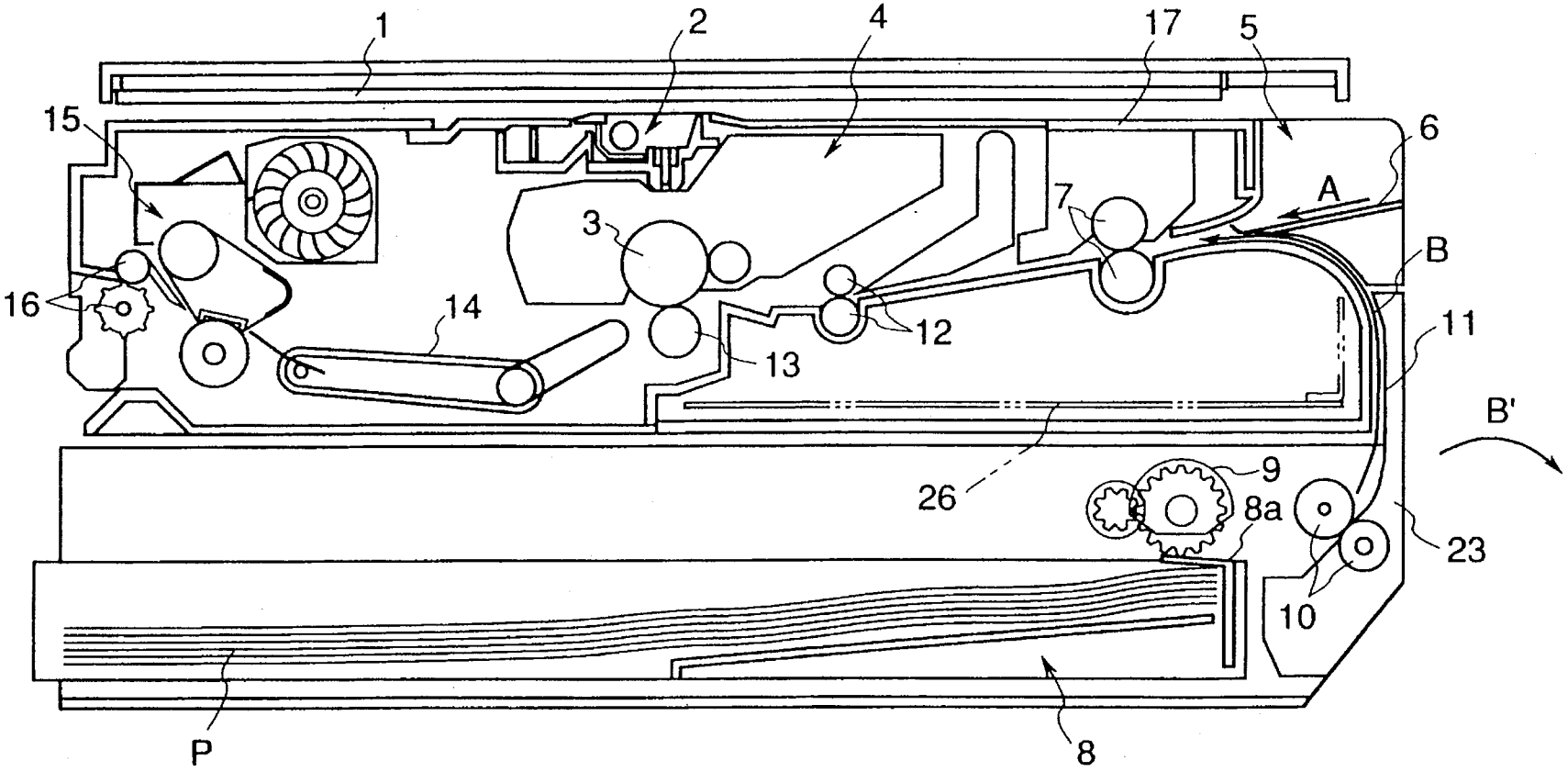
FIG. 1 is a schematic sectional view of a copying machine according to a first embodiment of the present invention.
Figure 2:
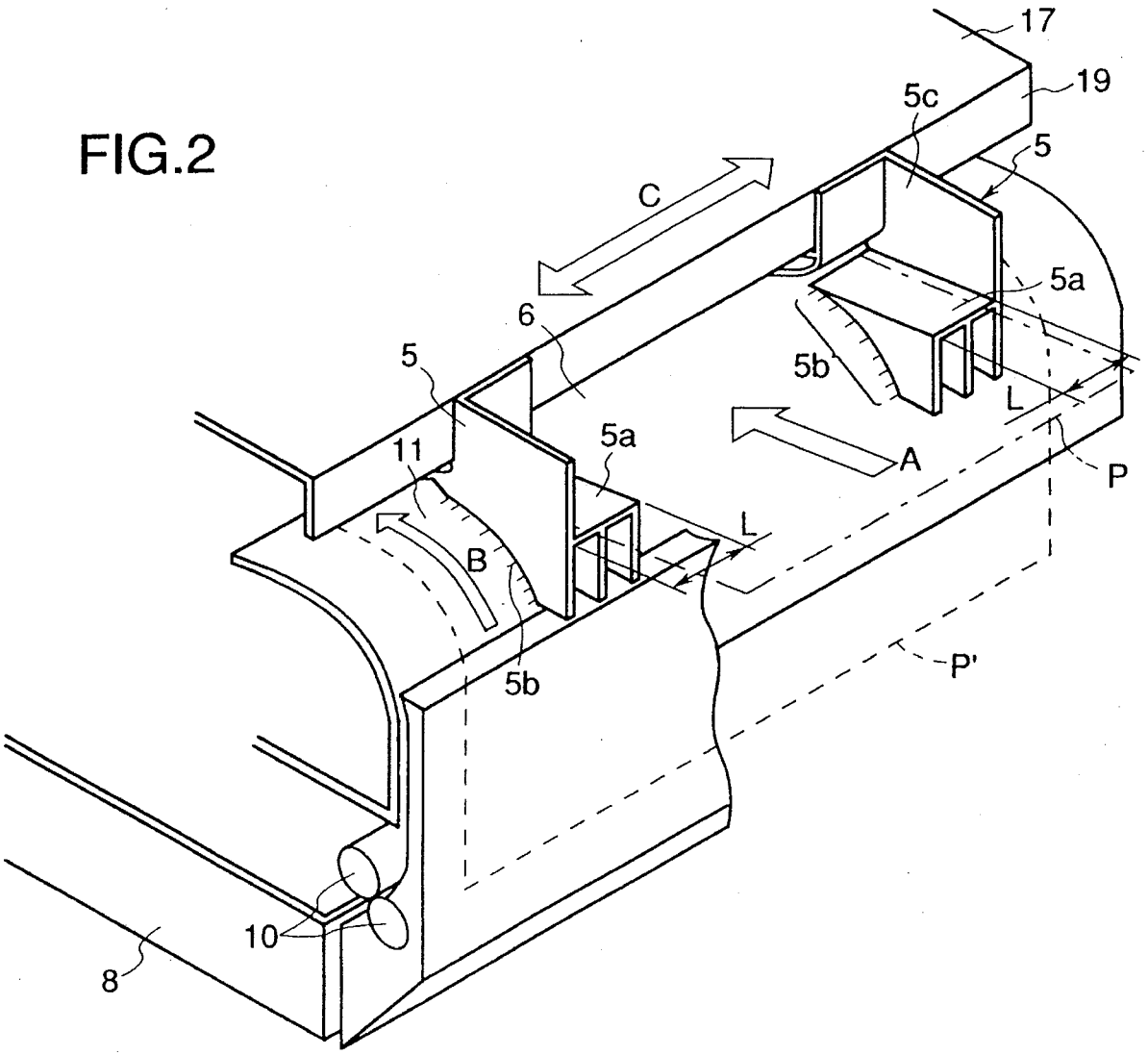
FIG. 2 is a perspective view of guide members.
Figure 3:
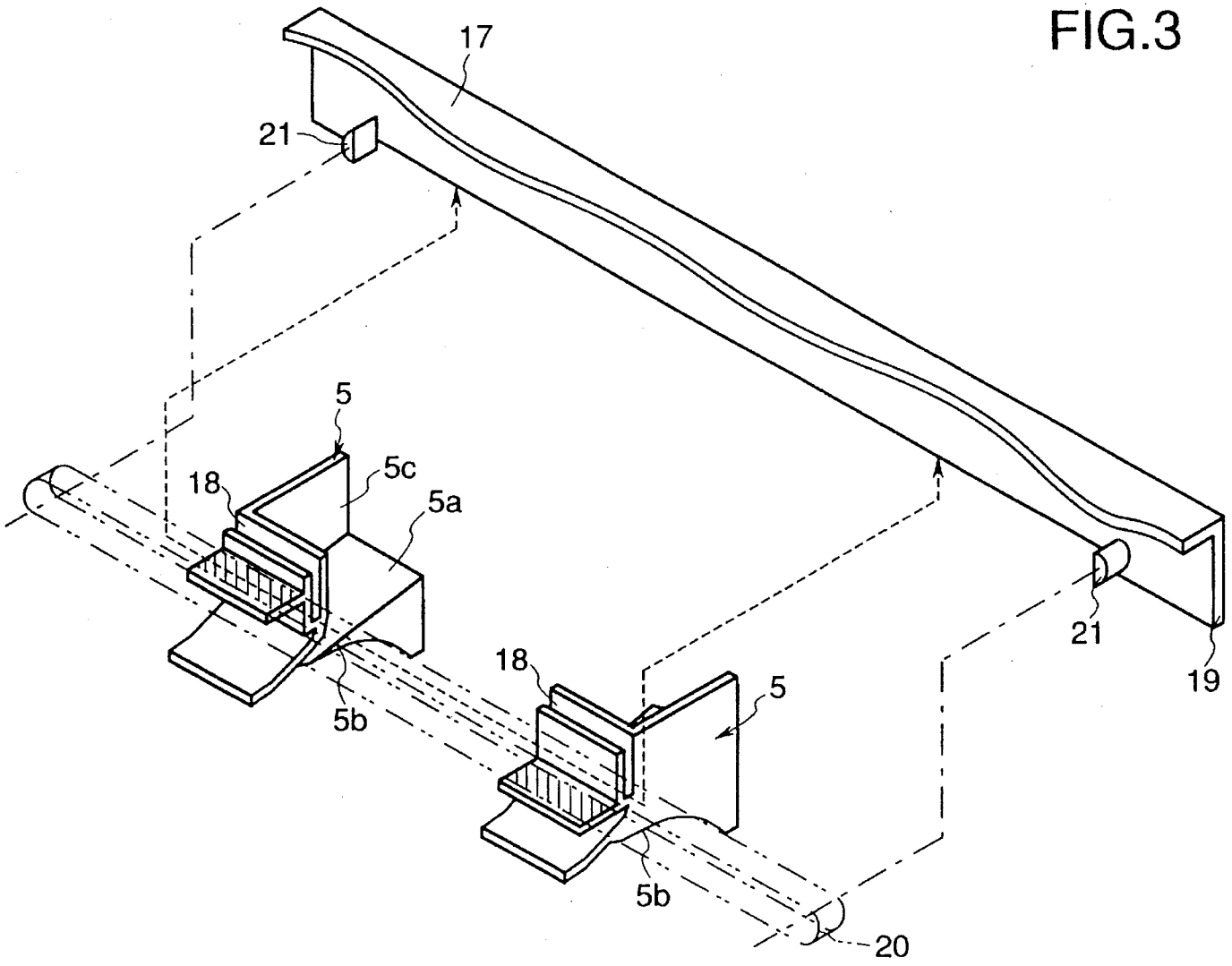
FIG. 3 is a perspective view showing shifting movements of the guide members.

First, an image forming apparatus (copying machine) according to a first embodiment of the present invention will be explained with reference to FIGS. 1 to 3. FIG. 1 is a schematic sectional view of the copying machine, FIG. 2 is a perspective view of guide members, and FIG. 3 is a perspective view showing shifting movements of the guide members.

A schematic construction of the copying machine will be firstly explained with reference to FIG. 1. The copying machine comprises an original resting plate 1 which can be shifted in a left and right direction (FIG. 1) and on which originals can be rested. The original rested on the original resting plate 1 is illuminated by an optical reading system 2, and light reflected from the original is focused on a photosensitive drum 3. The photosensitive drum 3 is incorporated into a process cartridge having a plurality of image forming process means, and the process cartridge is removably mounted to the copying machine. Around the photosensitive drum 3, there are arranged charge means, developing means, cleaning means and the like. The photosensitive drum 3 is previously charged by the charge means, so that, when the light reflected from the original is focused on the photosensitive drum, an electrostatic latent image is formed on the drum. Then, the latent image is visualized with developer (toner) by the developing means as a developer image. Then, the developer image is transferred onto a sheet at a transfer portion. After the developer image is transferred to the sheet, the toner remaining on the photosensitive drum 3 is removed by the cleaning means for preparation for next image formation.

The copying machine further comprises a manual insertion guides (first sheet supply means) 5 for supplying the sheet P by manual insertion. The manual insertion guides 5 define a first convey path 6 so that, when the sheet P is manually inserted in a direction shown by the arrow A, the sheet is supplied to a pair of convey rollers 7. A cassette 8 containing a plurality of sheets P is removably mounted within a lower portion of the copying machine. A sheet supply roller 9 forms a part of a second sheet supply means. The sheets P stacked in the cassette 8 are separated one by one from the uppermost one by means of the sheet supply roller 9 and a separation pawl 8*a* formed on the cassette 8.

A pair of cassette convey rollers 10 serve to reversely rotate and convey the sheet P supplied from the cassette 8 by the sheet supply roller 9 in a direction B through a second convey path 11 up to the pair of convey rollers 7. A convey path guide 23 can be rotated in a direction shown by the arrow B' so that, when the guide 23 is so rotated, the sheet P jammed in the second convey path 11 can be removed. A pair of register rollers 12 serve to correct the skew-feed of the sheet P conveyed by the pair of convey rollers 7 by abutting a tip end of the sheet against a nip between the regist rollers and then to send the sheet P to the transfer portion in registration with the developer image formed on the photosensitive drum 3.

A transfer roller 13 is abutted against the photosensitive drum 3 and serves to transfer the developer image formed on the photosensitive drum onto the sheet P. A sheet convey device 14 serves to convey the sheet P to which the developer image was transferred. A fixing device 15 serves to fix the developer image to the sheet P with heat and pressure. The sheet P to which the image was fixed is sent to a pair of discharge rollers 16 by which the sheet is discharged out of the copying machine.

Figure 10:
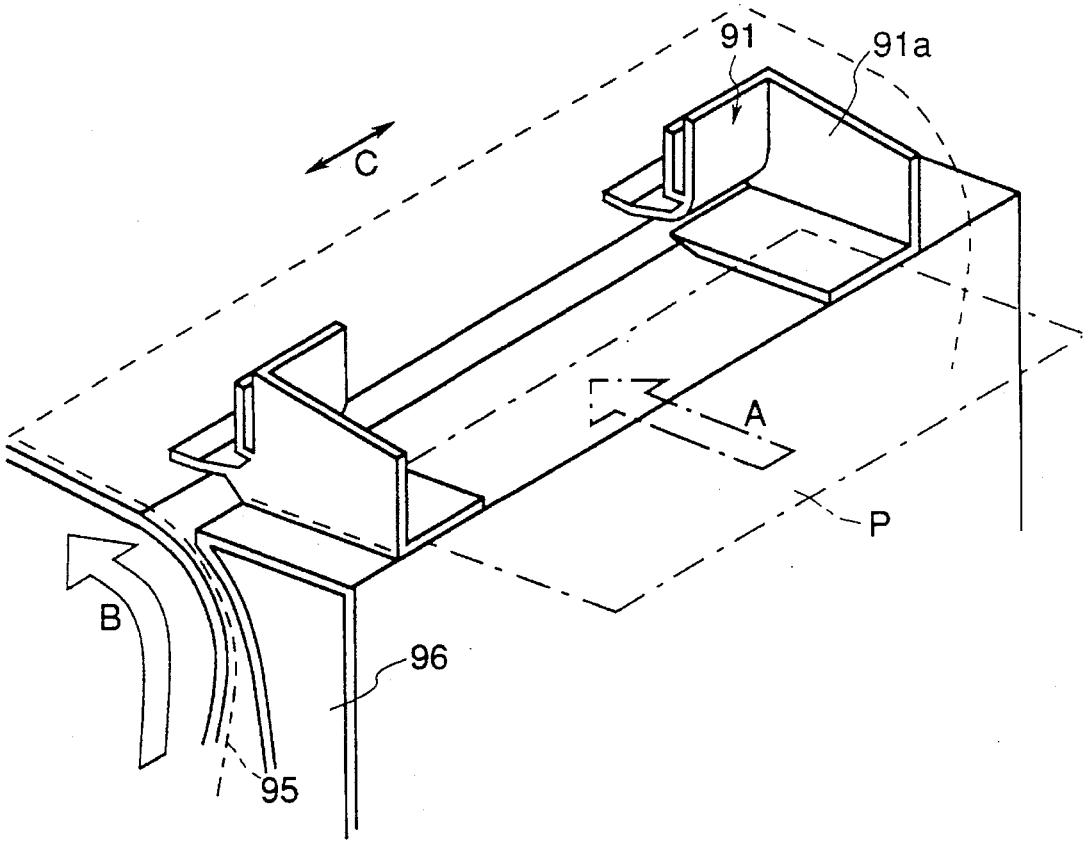
FIG.10 PRIOR ART
FIG. 10 is a perspective view of conventional guide members.
Figure 11:
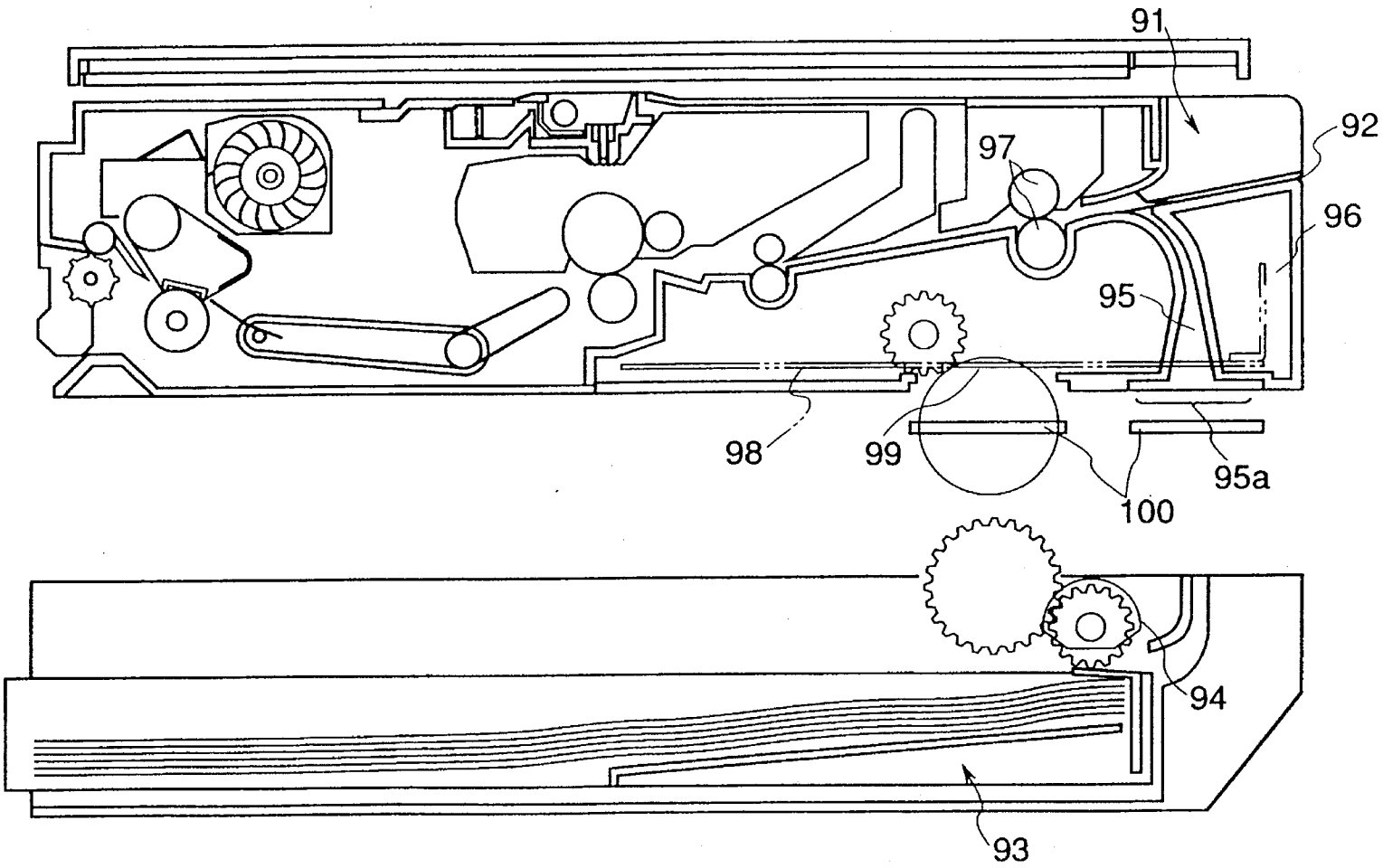
FIG. 11 PRIOR ART
FIG. 11 is a schematic sectional view of the conventional copying machine, showing accommodation of option.

With the arrangement as mentioned above, as shown in FIG. 2, the manually inserted sheet P (shown by the dot and chain line in FIG. 2) conveyed through the first convey path 6 is guided by first guide surfaces 5*a* of the manual insertion guides 5. On the other hand, the automatically supplied sheet P' (shown by the broken line in FIG. 2) conveyed through the second convey path 11 is guided by second guide surfaces 5*b* of the manual insertion guides 5. In this way, the respective sheet is directed to the pair of convey rollers 7. Accordingly, the manual insertion guides 5 serve to guide the sheet by the guide surfaces formed at a junction between the first and second convey paths 6, 11. Thus, the conventional junction guide (FIG. 10) can be eliminated.

Next, the concrete construction of the manual insertion guides 5 will be explained with reference to FIGS. 2 and 3. As mentioned above, the manual insertion guides 5 have the first guide surfaces 5*a* and the second guide surfaces 5*b* for guiding the manually inserted sheet conveyed through the first convey path 6 and the automatically supplied sheet conveyed through the second convey path 11, respectively. The manual insertion guides 5 are shiftable in a direction (shown by the arrow C in FIG. 2) perpendicular to a sheet conveying direction with respect to a cover 17 of the copying machine.

Now, shifting movements of the manual insertion guides 5 will be explained with reference to FIG. 3. Grooves or recesses 18 are formed in the respective manual insertion guides 5. The grooves 18 are slidably engaged by a guide portion 19 of the cover 17. Further, the manual insertion guides 5 are connected to a flexible film belt 20 which is an endless belt and which extends between and wound around belt sliding members 21 formed on the cover 17 in a spaced relation in the left and right direction. With this arrangement, one of the manual insertion guides 5 can be shifted in synchronous with the movement of the other manual insertion guide. Thus, side guide surfaces 5*c* of the manual insertion guides 5 can be shifted to a position corresponding to the size of the sheet in a sheet widthwise direction. Accordingly, during the manual insertion sheet supply, lateral edges of the sheet P conveyed in the first convey path 6 can be regulated by the side guide surfaces 5*c* of the manual insertion guides.

Alternatively, the manual insertion guides 5 may be shifted by a rack/pinion mechanism. Incidentally, in the illustrated embodiment, while the sheet is conveyed with a center reference, one side reference may be adopted.

A lateral dimension or distance L (FIG. 2) between the manual insertion guides 5 is determined by the size of the minimum available sheet. However, in consideration of the sheet supply from the cassette 8, a minimum size of the lateral dimension L may be set to a longitudinal size (about 148 mm) of a post card so that the lateral dimension can be greatly varied and the sheet supply ability can be stabilized.

With the arrangement as mentioned above, since the manual insertion sheet supply guide surfaces and the automatic sheet supply guide surfaces are integrally formed on the manual insertion guides 5, any junction guide can be omitted to reduce the size of the copying machine and the number of parts, thereby making the copying machine cheaper.

Next, another embodiment of an image forming apparatus (copying machine wherein an automatic sheet supply portion can be used as option) will be explained with reference to FIG. 4. Incidentally, since the general construction of the copying machine according to this embodiment is the same as that of the first embodiment, the same elements are designated by the same reference numerals as those in the first embodiment and explanation thereof will be omitted. Further, since manual insertion guides 5 are symmetrical with each other, only one of the manual insertion guides will be explained.

Figure 4:
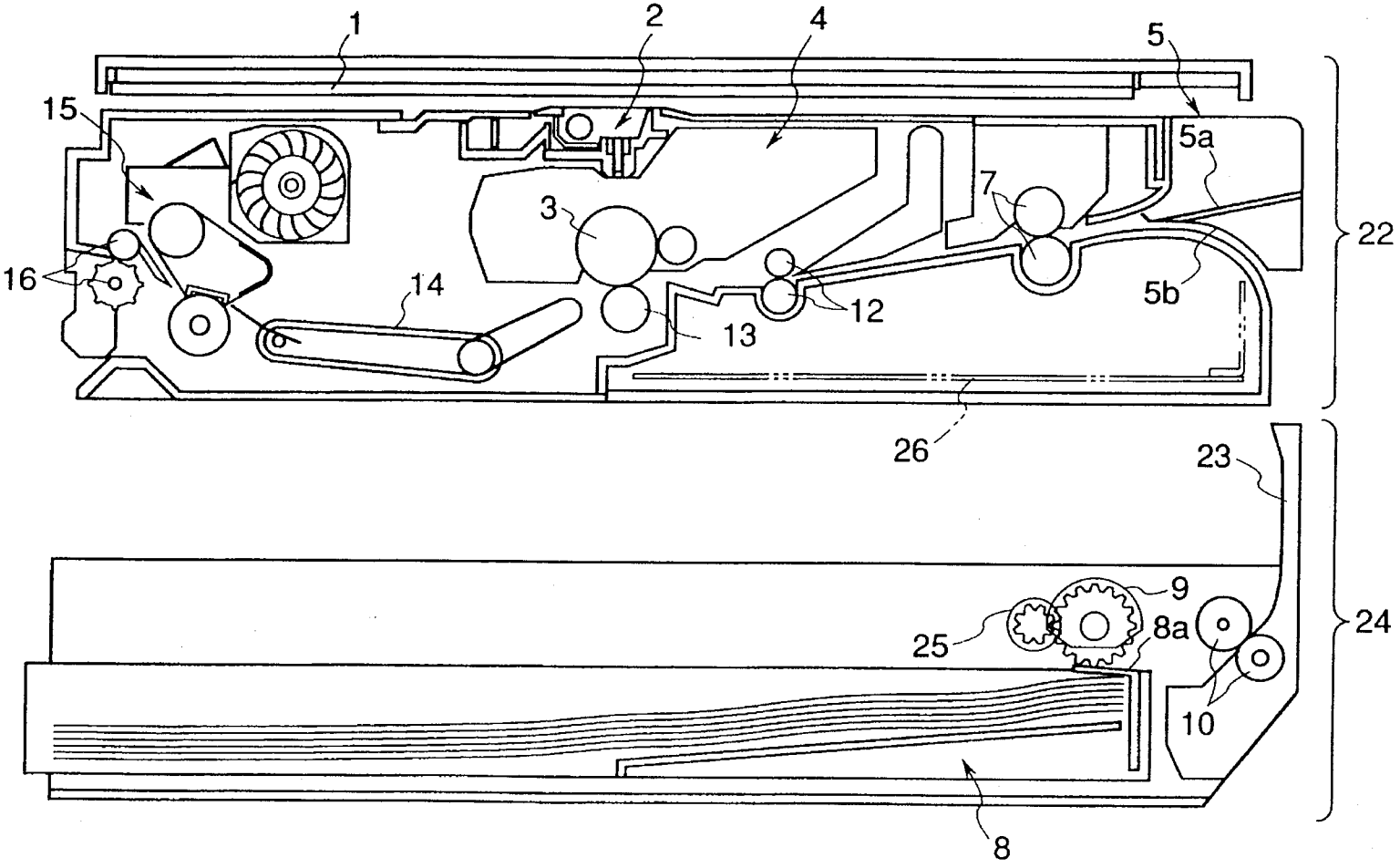
FIG. 4 is a schematic sectional view of a copying machine according to a second embodiment of the present invention.

As shown in FIG. 4, in this embodiment, an automatic sheet supply unit 24 comprising a cassette 8, a sheet supply roller 9, a pair of convey rollers 10 and a convey path guide 23 can be used as option with respect to a copying machine 22 having a manual insertion sheet supply means alone. Each manual insertion guide 5 has a manual insertion sheet supply guide surface **5*a* and an automatic sheet supply guide surface 5*b*. Further, the automatic sheet supply unit 24 has an independent drive source 25 for driving the sheet supply roller 9** and the like.

Since the automatic sheet supply guide surface **5*b* is integrally formed on each manual insertion guide 5, a second convey path 11 can be arranged nearer a side (right side in FIG. 4) of the apparatus than the above-mentioned conventional second convey path 95, thereby establishing an effective installation space for an electric portion 26** and the like at a lower portion of the apparatus.

Further, in this embodiment, since the drive source 25 is independently formed in the automatic sheet supply unit 24, the copying machine 22 having the manual insertion sheet supply means alone is not required to have an opening for accommodating option and any member for closing such an opening. That is to say, in the copying machine 22 in which the automatic sheet supply unit 24 can be used as option, there is no spatial limitation in the copying machine 22 when the automatic sheet supply unit is not used, thereby permitting the compactness of the machine, and it is possible to provide an image forming apparatus having no opening for accommodating option.

Figure 5:
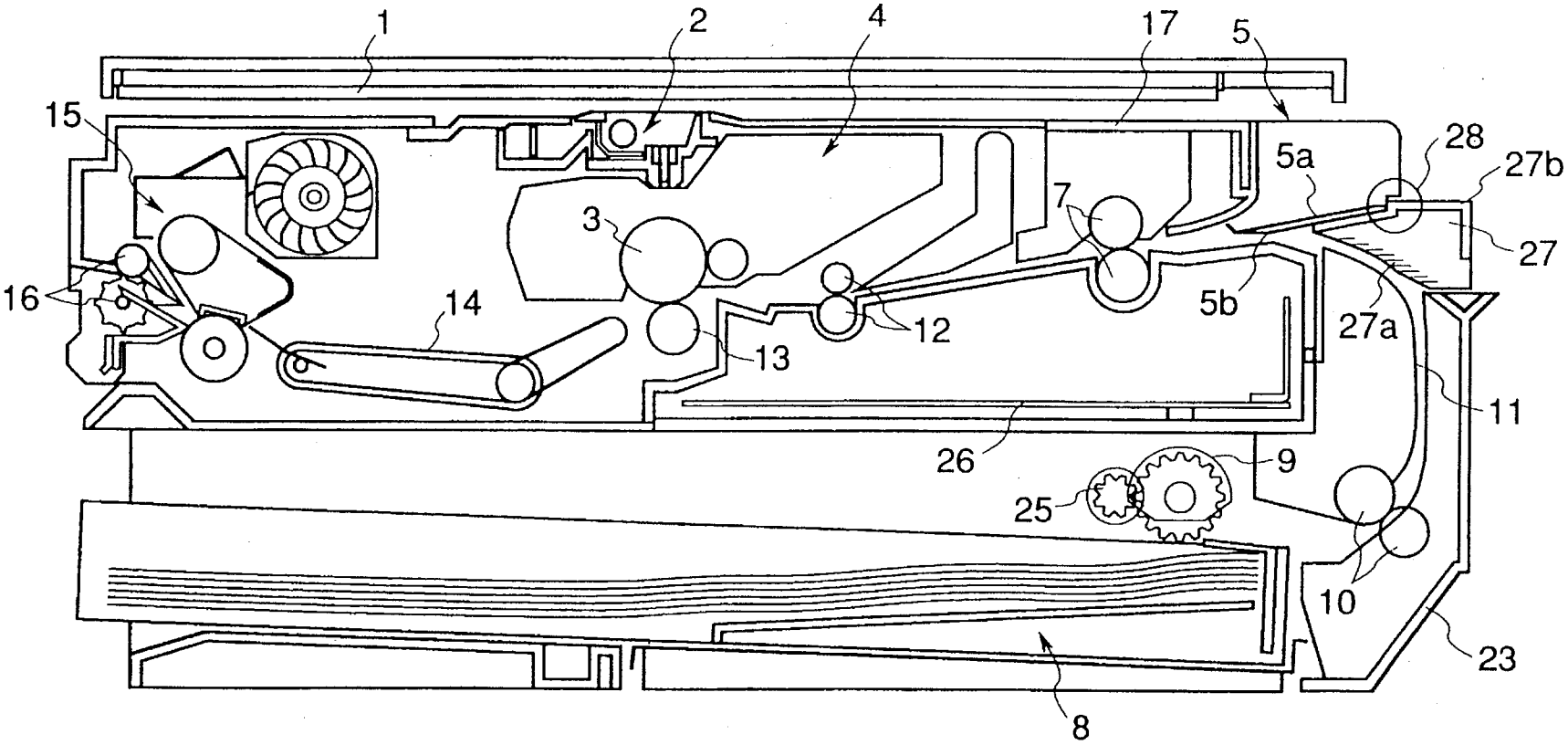
FIG. 5 is a schematic sectional view of a copying machine according to a third embodiment of the present invention.

Next, a further embodiment of an image forming apparatus (copying machine in which an automatic sheet supply portion is used as option) will be explained with reference to FIGS. 5 to 7. Incidentally, since the general construction of the copying machine according to this embodiment is the same as that of the first embodiment, the same elements are designated by the same reference numerals as those in the first embodiment and explanation thereof will be omitted. Further, since manual insertion guides 5 are symmetrical with each other, only one of the manual insertion guides will be explained.

In the above-mentioned first and second embodiments, the manual insertion guides 5 are shiftable in the direction perpendicular to the sheet conveying direction and the sheet is automatically supplied from the cassette 8 regardless of the positions of the manual insertion guides. By the way, in this third embodiment, in consideration of the fact that the manual insertion guides 5 are positioned at both lateral ends in the widthwise direction or are shifted toward a central portion, as shown in FIG. 5, there is provided an auxiliary cover 27 for guiding the sheet to the second guide surfaces **5*b* of the manual insertion guides 5 along the entire width of the sheet. The auxiliary cover 27 has a guide surface 27*a* for guiding the sheet P conveyed through the second convey path 11 to the second guide surfaces 5*b* of the manual insertion guides 5**.

With this arrangement, even when the above-mentioned distance L between the manual insertion guides 5 is small, the auxiliary cover helps the conveyance of the sheet to the second guide surfaces **5*b*, thereby stabilizing the conveying ability regardless of the size of the sheet supplied from the automatic sheet supply portion and a sheet condition (curled sheet or folded sheet). Further, an upper surface 27*b* of the auxiliary cover 27 also serves to act as a guide for guiding the manually inserted sheet, and, thus, acts as a manual insertion tray 5. Further, by providing a step 28 on the auxiliary cover 27, it is possible to prevent erroneous manual insertion of the sheet into the second guide surfaces 5*b***.

Figure 6:
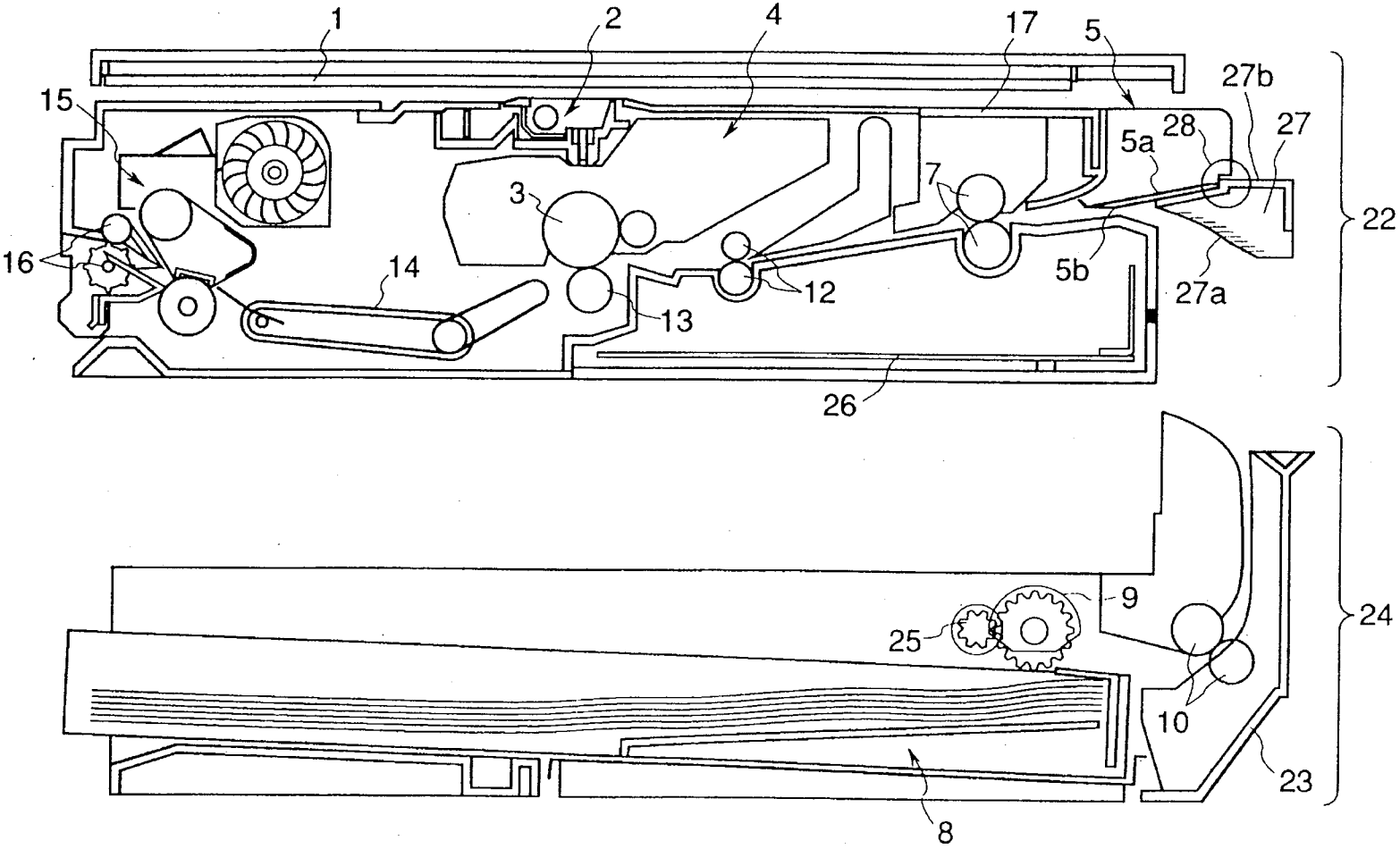
FIG. 6 is a schematic sectional view of the copying machine of FIG. 5, showing accommodation of option.
Figure 7:
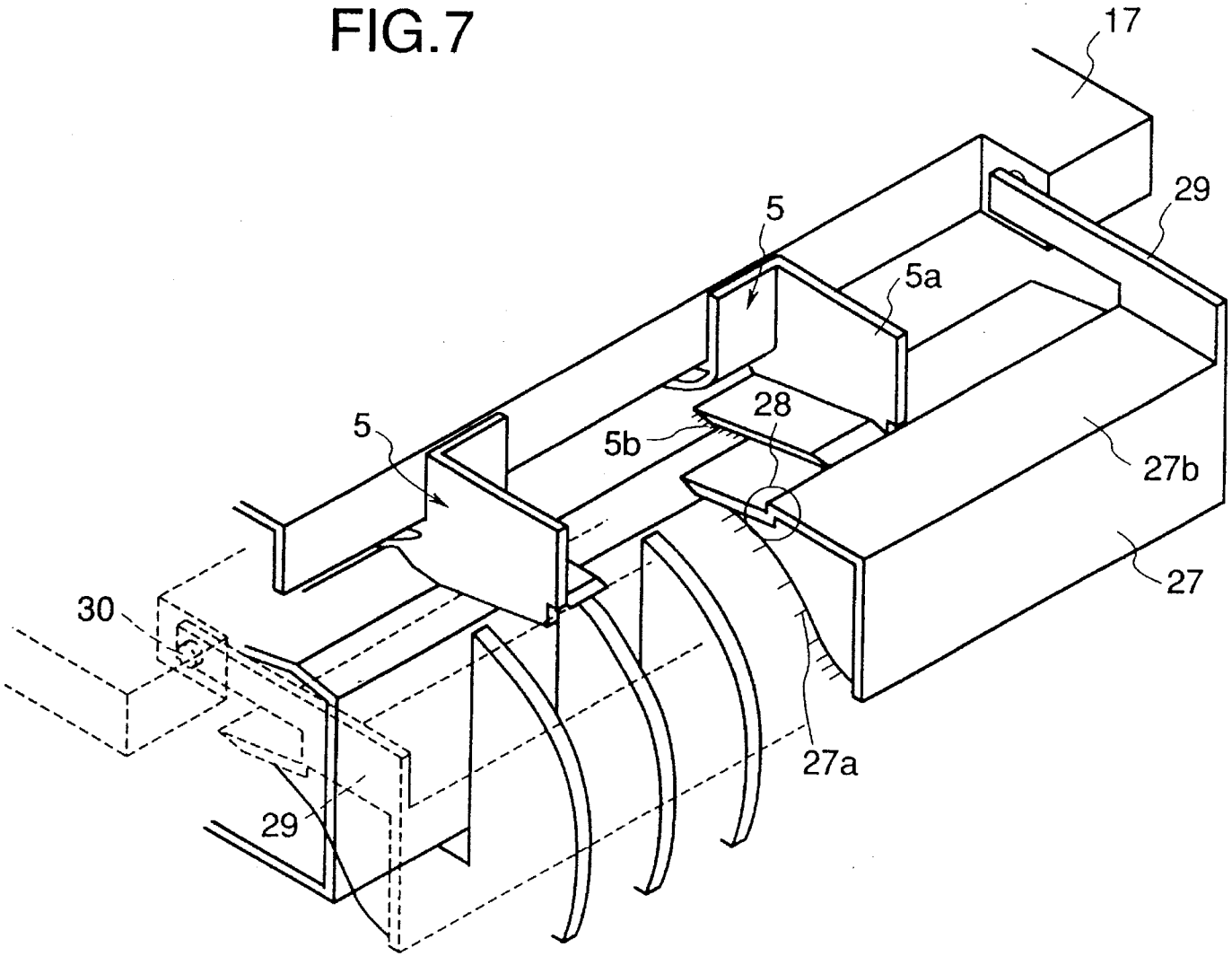
FIG. 7 is a perspective view for showing the attachment of an auxiliary cover.

Incidentally, also in this third embodiment, accommodation of option is permitted, as shown in FIG. 6. That is to say, when the copying machine 22 having the manual insertion sheet supply means alone is used independently, the auxiliary cover 27 may be removed or, alternatively, a manual insertion tray (not shown) may be attached to the machine. Further, since the second convey path 11 can be arranged nearer the side of the machine than the conventional case, the installation space for the electric portion 26 cannot be reduced.

Now, the attachment of the auxiliary cover 27 will be described with reference to FIG. 7. Attachment arm portions 29 are formed on both ends of the auxiliary cover 27, and an attachment pin 30 is formed on one end of each attachment arm portion 29. With this arrangement, when the attachment pins 30 are fitted into attachment holes formed in the body cover 17 of the copying machine, the auxiliary cover 27 is attached to the body cover 17 via the attachment arm portions 29.

Figure 8:
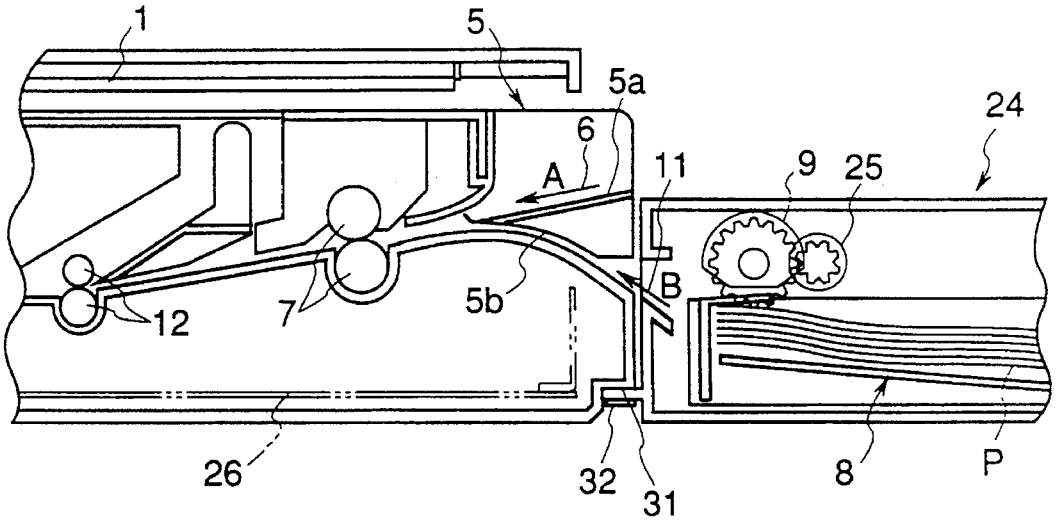
FIG. 8 is a schematic partial sectional view of a copying machine according to a fourth embodiment of the present invention, showing accommodation of option.
Figure 9:
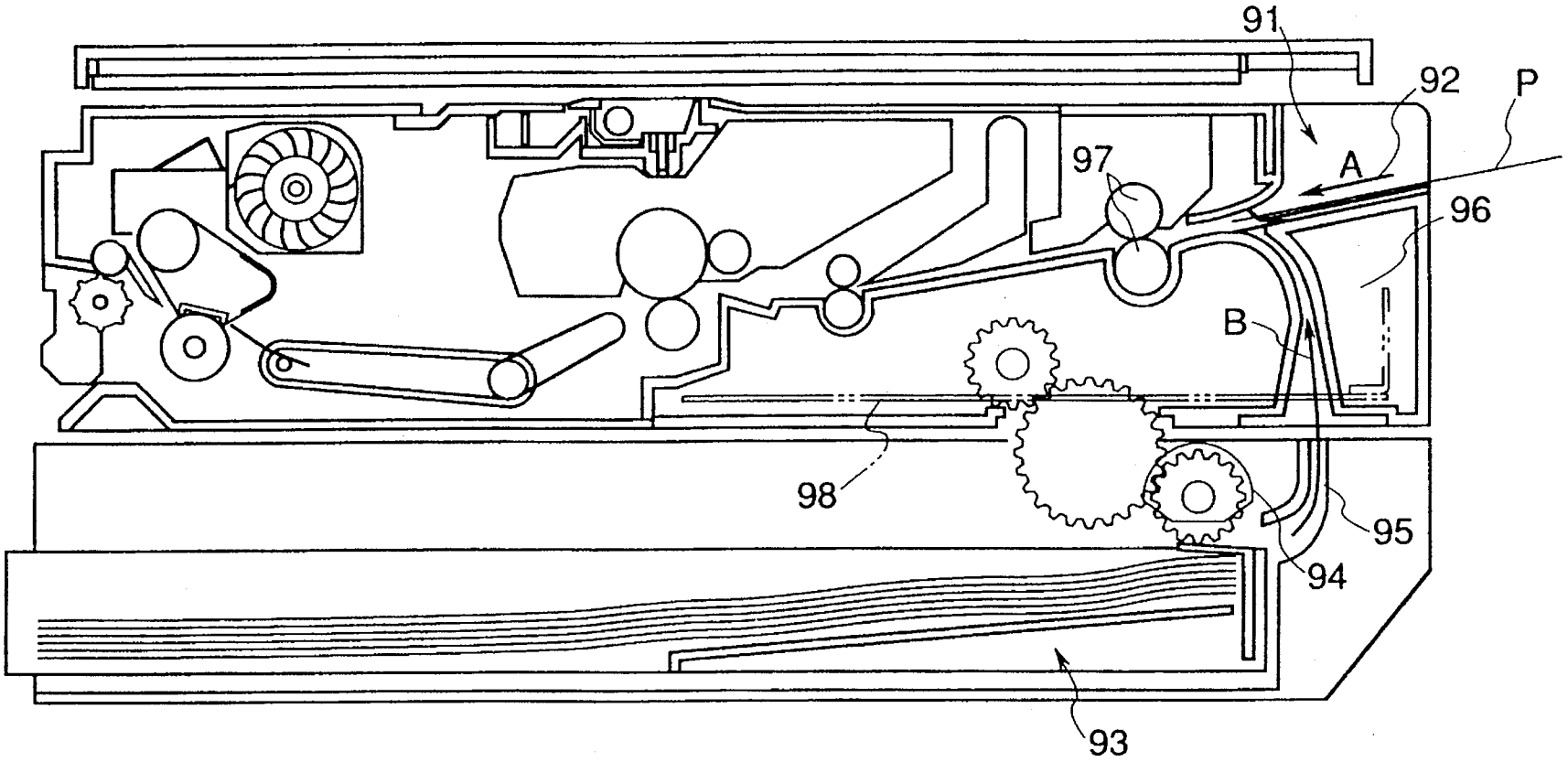
FIG.9 PRIOR ART
FIG. 9 is a schematic sectional view of a conventional copying machine.

Next, a still further (fourth) embodiment of an image forming apparatus (copying machine in which an automatic sheet supply portion is used as option) will be explained with reference to FIG. 8. Incidentally, since the general construction of the copying machine according to this embodiment is the same as that of the first embodiment, the same elements are designated by the same reference numerals as those in the first embodiment and explanation thereof will be omitted. Further, since manual insertion guides 5 are symmetrical with each other, only one of the manual insertion guides will be explained.

In the above-mentioned first to third embodiments, while an example that the cassette 8 is removably mounted to the lower portion of the copying machine was explained, in this fourth embodiment, the automatic sheet supply unit 24 is mounted to a side surface of the copying machine 22.

The automatic sheet supply unit 24 includes a cassette 8, a sheet supply roller 9 and a drive motor 25 for driving the sheet supply roller. The automatic sheet supply unit 24 is connected to connecting portions 31 of the copying machine 22 via connecting tongues 32 formed on the unit 24. A sheet P supplied from the cassette 8 by the sheet supply roller 9 is conveyed in a direction shown by the arrow B to enter into a second convey path 11 and then is conveyed toward the interior of the copying machine along the second guide surfaces 5*b* of the manual insertion guides 5.

With this arrangement, the automatic sheet supply unit can easily be used as option without changing the construction of the copying machine. Further, since the second convey path 11 can be arranged nearer the side of the copying machine than the conventional case, the installation space for the electric portion 26 in the copying machine 22 is not reduced.

In the above-mentioned embodiments, since it is so designed that the first guide surfaces (upper surfaces) 5*a* and the side guide surfaces 5*c* (for regulating the sheet in the widthwise direction) are used in the manual insertion sheet supply and the second guide surfaces (upper surfaces) 5*b* are used in the automatic sheet supply, the automatically supplied sheet can be guided regardless of the positions of the manual insertion guides. Further, in the above-mentioned embodiments, while the manual insertion guides of center reference type was explained, the manual insertion guides may be of one-side reference type. Furthermore, regarding the automatic sheet supply portion for automatically supplying the sheet P, the shape and/or dimension of the manual insertion guide and the cover may be appropriately selected in accordance with various conditions of the automatic sheet supply unit.

Further, in the above-mentioned embodiments, while the copying machine was explained as an example of the image forming apparatus, the present invention is not limited to the copying machine but may be applied to other image forming apparatuses such as laser beam printers.

As mentioned above, according to the present invention, at the junction between the first convey path for the manual insertion sheet supply and the second convey path for the automatic sheet supply, the manually inserted sheet and the automatically supplied sheet are guided by the first and second guide surfaces formed on the guide members, respectively. With this arrangement, it is not required to previously provide a second convey path as is in the conventional case, and the junction guide can be omitted. Thus, the spacial loss due to the presence of the second convey path and the junction guide can be prevented, thereby making the apparatus compact and reducing the number of parts resulting in the reduction of the cost of the apparatus.

Further, when the automatic sheet supply unit is mounted to the side surface of the apparatus as option, since the automatically supplied sheet can be supplied by utilizing the second guide surfaces of the guide members, the apparatus can easily accommodate the option without modifying the construction of the apparatus. Thus, since it is not required to previously provide the second convey path and the opening at the lower portion of the apparatus, the space in the apparatus can be used effectively and the apparatus can be made compact. Further, any member for closing the opening is not required.

Further, even when the widthwise distance between the guide members differs from the size of the automatically supplied sheet, since the first guide surfaces (upper surfaces) are used in the manual insertion sheet supply and the second guide surfaces (lower surfaces) are used in the automatic sheet supply, the widthwise regulation of the automatically supplied sheet by means of the guide members is not required, thereby reducing a danger of a sheet jam.

What is claimed is:

1. A sheet supply apparatus for supplying a sheet to an image forming means, comprising:

a side regulating member for regulating side edges of a sheet manually inserted to said image forming means; and sheet supporting means for supporting a sheet to be supplied to said image forming means; and a reverse rotation guide for reversing and guiding the sheet fed from said sheet supporting means toward said image forming means;

wherein said side regulating member has a guide portion integrally formed therewith to constitute a part of said reverse rotation guide.

2. A sheet supply apparatus according to claim 1, wherein said side regulating member has a sheet supporting portion provided at an upper side thereof for supporting the manually inserted sheet, and the guide portion is provided at a lower side thereof.

3. A sheet supply apparatus according to claim 2, further comprising a shifting mechanism for shifting said side regulating member in a widthwise direction of the sheet in accordance with a size of the sheet.

4. A sheet supply apparatus according to claim 1, wherein said sheet supporting means has a cassette for containing a plurality of sheets, supply means for feeding out the sheets from said cassette, and separation means for separating the sheets fed by said supply means one by one.

5. An image forming apparatus comprising:

image forming means for forming an image on a sheet;

a side regulating member for regulating side edges of a sheet manually inserted to said image forming means; and sheet supporting means for supporting a sheet to be supplied to said image forming means; and a reverse rotation guide for reversing and guiding the sheet fed from said sheet supporting means toward said image forming means;

wherein said side regulating member has a guide portion integrally formed therewith to constitute a part of said reverse rotation guide.

6. An image forming apparatus according to claim 5, further comprising convey means for conveying the sheet manually inserted from said side regulating member and the sheet guided by said guide portion to said image forming means.

7. An image forming apparatus according to claim 5, wherein said side regulating member is arranged at one side of the apparatus and said supporting means is arranged below said image forming means, wherein the sheet fed from said sheet supporting means is reversed and sent to said image forming means, and said guide portion serves to guide the reversing of the sheet.

8. An image forming apparatus according to claim 5, wherein said sheet supporting means comprises a sheet supply unit removably mountable to a body of the image forming apparatus including said image forming means.

9. An image forming apparatus according to claim 8, wherein said sheet supply unit is removably mounted to a lower surface of said body.

10. An image forming apparatus according to claim 8, wherein said sheet supply unit is removably mounted to a side surface of said body.

11. An image forming apparatus according to any one of claims 8 to 10, wherein said sheet supply unit comprises a cassette for containing a plurality of sheets, supply means for feeding out the sheets from said cassette, and separation means for separating the sheets fed by said supply means one by one.

12. A sheet supply apparatus for supplying a sheet to an image forming means, comprising:

a side regulating member for regulating side edges of a sheet manually inserted, said side regulating member including a first guide portion for guiding the sheet manually inserted to said image forming means, and a second guide portion for guiding sheets other than the sheets guided by said first guide portion to said image forming means; and an auxiliary guide member including a first auxiliary guide portion for guiding the sheet manually inserted to said first guide portion, and a second auxiliary guide portion for guiding the other sheet to said second guide portion;

wherein said second guide portion and said second auxiliary guide portion constitute a continuous surface for guiding the sheet other than the manually inserted sheet.

13. A sheet supply apparatus according to claim 12, wherein said first guide portion is formed on an upper surface of said side regulating member and said second guide portion is formed on a lower surface of said side regulating member.

14. A sheet supply apparatus according to claim 12, wherein said first guide portion and said first auxiliary guide portion constitute a continuous surface for guiding the manually inserted sheet.

15. A sheet supply apparatus according to claim 12, wherein said second guide portion and said second auxiliary guide portion constitute a part of a reverse guide portion for reversing and guiding the sheet.

16. A sheet supply apparatus according to claim 12, wherein said second guide portion and said second auxiliary guide portion guide a sheet fed from a sheet stacking means.

17. A sheet supply apparatus according to claim 16, wherein said sheet stacking means is a cassette in which sheets are stacked and are contained, and said cassette is removably mountable to the sheet supply apparatus.

18. An image forming apparatus comprising:

image forming means for forming an image on a sheet;

a side regulating member for regulating side edges of a sheet manually inserted, said side regulating member including a first guide portion for guiding the sheet manually inserted to said image forming means, and a second guide portion for guiding a sheet other than the sheet guided by said first guide portion to said image forming means; and an auxiliary guide member including a first auxiliary guide portion for guiding the sheet manually inserted to said first guide portion, and a second auxiliary guide portion for guiding the other sheet to said second guide portion;

wherein said second guide portion and said second auxiliary guiding portion constitute a continuous surface for guiding the sheet other than the manually inserted sheet.

19. A sheet supply apparatus for supplying a sheet to an image forming means, comprising:

a side regulating member for regulating side edges of the sheet manually inserted to said image forming means; and sheet supporting means for supporting a sheet to be supplied to said image forming means;

wherein said side regulating member has a guide portion provided at a lower side thereof for guiding the sheet fed from said sheet supporting means toward said image forming means, and a sheet support portion provided at an upper side thereof for supporting the sheet manually inserted.

20. A sheet supply apparatus according to claim 19, further comprising a shifting mechanism for shifting said side regulating member in a widthwise direction of the sheet in accordance with size of the sheet.

21. A sheet supply apparatus according to claim 19, wherein said sheet supporting means has a cassette for containing a plurality of sheets, supply means for feeding out the sheets from said cassette, and separation means for separating the sheets fed by said supply means one by one.

22. An image forming apparatus comprising:

image forming means for forming an image;

a side regulating member for regulating side edges of the sheet manually inserted to said image forming means; and sheet supporting means for supporting a sheet to be supplied to said image forming means;

wherein said side regulating member has a guide portion provided at a lower side thereof for guiding the sheet fed from said sheet supporting means toward said image forming means, and a sheet supporting portion provided at an upper side thereof for supporting the sheet manually inserted.

* * * * *

UNITED STATES PATENT AND TRADEMARK OFFICE

CERTIFICATE OF CORRECTION

PATENT NO. : 5,563,698

DATED : October 8, 1996

INVENTOR(S) : Okada

It is certified that error appears in the above-indentified patent and that said Letters Patent is hereby corrected as shown below:

On the title page, item:

[57] ABSTRACT:

Line 2, "is" should read --are--.

COLUMN 4:

Line 53, "synchronons" should read --synchronicity--.

Signed and Sealed this

Twenty-fifth Day of March, 1997

*Attest:*

*Attesting Officer*

BRUCE LEHMAN

*Commissioner of Patents and Trademarks*